United States Patent [19]

Eijnthoven et al.

[11] 4,052,340

[45] Oct. 4, 1977

[54] METHOD FOR PRODUCING A VOLTAGE DEPENDENT RESISTOR AND A VOLTAGE DEPENDENT RESISTOR OBTAINED THEREWITH

[75] Inventors: Ronald Karel Eijnthoven; Johannes Trudo Cornelis van Kemenade, both of Eindhoven, Netherlands

[73] Assignee: U.S. Philips Corporation, New York, N.Y.

[21] Appl. No.: 630,537

[22] Filed: Nov. 10, 1975

[30] Foreign Application Priority Data

Nov. 13, 1974 Netherlands ..... 7414775

[51] Int. Cl.[2] ..... H01B 1/08

[52] U.S. Cl. ..... 252/518; 252/519; 264/65; 338/20

[58] Field of Search ..... 252/518, 519; 338/20, 338/21; 264/65

[56] References Cited

U.S. PATENT DOCUMENTS

| | | | |
|---|---|---|---|
| 3,723,175 | 3/1973 | Masuyama et al. | 252/518 X |
| 3,872,582 | 3/1975 | Matsuoka et al. | 252/518 X |
| 3,938,069 | 2/1976 | May | 252/518 X |

*Primary Examiner*—Benjamin R. Padgett
*Assistant Examiner*—E. Suzanne Parr
*Attorney, Agent, or Firm*—Frank R. Trifari; Norman N. Spain

[57] ABSTRACT

Voltage dependent resistor obtained by sintering a body of a mixture of ZnO and other metal oxides in an atmosphere which contains bismuth.

3 Claims, No Drawings

METHOD FOR PRODUCING A VOLTAGE DEPENDENT RESISTOR AND A VOLTAGE DEPENDENT RESISTOR OBTAINED THEREWITH

The invention relates to a method for producing a voltage dependent resistor mainly consisting of a sintered body of zinc oxide and bismuth oxide in which small quantities of oxide of one or more other metals may have been incorporated and which is provided with ohmic electrodes at two opposite faces of the body and to a voltage dependent resistor obtained according to this method.

The said other metals may, for example be: aluminium, antimony, barium, borium, calcium, chromium, indium, cobalt, copper, manganese, molybdenum, nickel, strontium, tantalum, tin, titanium, iron. The ohmic electrodes at the opposite faces of the sintered body may consist of thin films of, for example silver, copper, aluminium, nickel-chromium.

In a known method these voltage dependent resistors are obtained by first producing a body from a mixture of zinc oxide and one or more oxides of the other said metals, bismuth oxide excepted. Thereafter a paste which mainly consists of bismuth oxide is applied to this body, and the body is sintered in an oxidizing atmosphere, usually in air. Bismuth ions are then diffused in the sintered body. This method has the drawback that it consists of two steps, the second step being particularly labour-intensive and difficult to reproduce.

The object of the invention is to provide a method for producing voltage dependent resistors in which these drawbacks are avoided as much as possible.

The method according to the invention is therefore characterized in that the resistor is produced by sintering a body of a mixture of zinc oxide and the other said oxides in a bismuth-containing atmosphere, whereafter the electrodes are applied in known manner. By means of a suitable choice of the sintering temperature, the sintering time and the bismuth concentration in the sintering atmosphere, the grain size and the bismuth content of the sintered body can be varied within wide limits and in a reproducible manner and, consequently, the properties of resistance.

In a preferred embodiment of the procedure according to the invention the body of a mixture of zinc oxide and the other said oxides is sintered in an oxidizing atmosphere which is in contact with molten bismuth oxide. To this end the molten bismuth oxide may have been incorporated in a body of porous material such as zirconium oxide and is, for example, in the same room where sintering takes place.

Practice has shown that sintering temperatures of between 900° and 1450° C are particularly suitable. The content in bismuth oxide in the resistance body produced to the method according to the invention, depends on the sintering temperature and the sintering time. The content may be between approximately 0.1 and 10% by weight. As also $V_0$ of the resistance body depends on the sintering time and the sintering temperature, it is in principle possible to produce resistance bodies with the method according to the invention which have the same $V_0$ at a different content in bismuth oxide.

In this way it becomes possible to optimize other properties of the material, for example the stability of the resistance body at a prolonged electrical load. In this respect $V_o$ is understood to be that voltage at which a current of 1 mA flows through the body. The method according to the invention will now be further explained with reference to the following embodiments.

EMBODIMENT I

Disc-shaped resistance bodies were manufactured by sintering pre-formed discs, consisting of a mixture of ZnO and CoO, which contain 1% by weight of CoO, in air in the presence of molten bismuth oxide in the sintering room, but not in contact with the discs, the bismuth oxide being in a container of sintered aluminium oxide. The disc-shaped resistance bodies had a thickness of 1 mm. Electrodes were applied at opposite face in the usual manner by burning-in of a metal paste. At various sintering temperatures and sintering times the values for $V_o$ and the bismuth oxide contents specified in the table were measured.

| Sintering temp. | Sintering time | $V_o$ | $Bi_2O_3$ content |
|---|---|---|---|
| 1000° C | 50 hrs | 200 | 4% by weight |
| 1100° C | 4 hrs | 200 | 1% by weight |
| 1200° C | ¾ hrs | 200 | 0.5% by weight |
| 1100° C | 2 hrs | 300 | 0.5% by weight |
| 1100° C | 1 hr | 700 | 0.25% by weight |

The value of $n$ in the equation which indicates the dependency of the current of the voltage applied $$I = (V/V_o)^n$$

exceeded in all cases 25.

EMBODIMENT II

As indicated in embodiment I the body made of a mixture of 0.5% by weight of CoO, 2.5% by weight of $Sb_2O_3$, 0.25% by weight of $MnO_2$, 0.5% by weight of $Cr_2O_3$, remainder ZnO, was sintered for four hours at 1100° C in air over molten bismuth oxide. $V_o$ of the resistance bodies thus obtained was 480V, $n$ being 45.

What is claimed is:

1. In a method for producing a voltage dependent resistor consisting mainly of a sintered body of zinc oxide and about 0.1–10% by weight of bismuth oxide in which, there is optionally present, small quantities of oxides of other metals and which body is provided, at opposite faces thereof, with ohmic electrodes, wherein the improvement comprises sintering a mixture of zinc oxide and oxides of metals which may be optionally present, at a temperature of between about 900° C – 1450° C, in an atmosphere containing bismuth oxide to produce a sintered body and then applying the ohmic electrodes to the resultant sintered body.

2. The method of claim 1 wherein the atmosphere is an oxidizing atmosphere in contact with molten bismuth oxide.

3. A voltage dependent resistor obtained according to claim 1.

* * * * *